United States Patent [19]

Eckles et al.

[11] 4,075,066

[45] Feb. 21, 1978

[54] ELECTROPLATING ZINC, AMMONIA-FREE ACID ZINC PLATING BATH THEREFOR AND ADDITIVE COMPOSITION THEREFOR

[75] Inventors: William Edward Eckles, Cleveland Heights; Valerie Canaris, Parma, both of Ohio

[73] Assignee: R. O. Hull & Company, Inc., Cleveland, Ohio

[21] Appl. No.: 762,883

[22] Filed: Jan. 27, 1977

[51] Int. Cl.[2] ..... C25D 3/22

[52] U.S. Cl. ..... 204/55 R; 204/DIG. 2; 252/182

[58] Field of Search ..... 204/55 R, 55 Y, DIG. 2; 252/182

[56] References Cited

U.S. PATENT DOCUMENTS

| | | | |
|---|---|---|---|
| 3,767,540 | 10/1973 | Rosenberg | 204/55 R |
| 3,787,297 | 1/1974 | Beckwith et al. | 204/55 R |
| 3,855,085 | 12/1974 | Rushmere | 204/55 R |
| 3,878,069 | 4/1975 | Todt et al. | 204/55 R |
| 3,891,520 | 6/1975 | Todt et al. | 204/55 R |
| 3,920,528 | 11/1975 | Voss et al. | 204/55 R |
| 3,928,149 | 12/1975 | Steeg | 204/55 R |
| 4,014,761 | 3/1977 | Passal | 204/55 R |

*Primary Examiner*—G. L. Kaplan
*Attorney, Agent, or Firm*—Armand P. Boisselle

[57] ABSTRACT

The present invention provides an ammonia-free acid zinc plating bath for electrodepositing bright zinc on a substrate in which the zinc deposit produced thereby is ductile and presents a glossy to bright coating on the substrate over a wide cathodic current density range. The ammonia-free acid zinc plating baths of the invention comprise zinc ions, chloride ions, at least one polyoxyalkylated naphthol, at least one aromatic carboxylic acid or bath-soluble salt thereof, and at least one anionic aromatic sulfonic acid or bath-soluble salt thereof. In addition to the above components, the ammonia-free acid zinc plating baths of the invention may contain at least one nonionic polyoxyethylene compound and at least one aromatic aldehyde, ketone, or mixtures thereof. The ammonia-free acid zinc plating baths of the invention are free from significant amounts of complexing agents that would impede the removal of zinc ions from the baths prior to disposal.

44 Claims, No Drawings

ELECTROPLATING ZINC, AMMONIA-FREE ACID ZINC PLATING BATH THEREFOR AND ADDITIVE COMPOSITION THEREFOR

BACKGROUND OF THE INVENTION

The present invention relates to an acid plating bath for electrodepositing bright zinc on a substrate in which the zinc deposit produced thereby is ductile and presents a glossy to bright coating on the substrate over a wide cathodic current density range. The invention relates also to a method of electrodepositing bright coatings on a substrate. More particularly this invention relates to improved zinc plating bath compositions which are free or substantially free of ammonium ions, and the method of plating with such baths.

Alkaline cyanide-containing zinc baths have been most widely used baths for electrodepositing bright zinc plate on substrates. These baths have various disadvantages due particularly to the cyanide content which is constant danger for the people working with the baths. Moreover, the baths are subject to aging due to the decomposition of the cyanide, and the waste water must be subjected to a costly treatment to destroy the cyanide ions and to precipitate zinc as hydroxide prior to disposal.

Alkaline solutions containing complex compounds of zinc and alkaline metal pyrophosphates have been proposed as replacements for cyanide baths and cyanide processes for the electrodeposition of bright zinc. The electrodeposition of zinc using a pyrophosphate bath, however, may result in relatively poor low current density coverage, spore formation, roughness and insufficient brightness. The use of phosphates also may produce waste disposal problems since phosphates are not easily removed and may promote the growth of undesirable aquatic plant life if discharged into streams. These disposal disadvantages limit the acceptance of the pyrophosphate zinc plating bath compositions in industrial applications.

The enactment and enforcement of various environmental protection laws, particularly with respect to improving water quality, have made it desirable and necessary to reduce or eliminate discharge of cyanides, phosphates and a number of metal ions contained in the waste water from plating plants. Accordingly, non-polluting bright zinc plating processes have been sought as alternatives to the zinc cyanide and phosphate-containing baths.

Acidic plating baths have been known, and these baths are cyanide-free. The acid zinc plating baths are much less toxic than the alkaline zinc plating baths and are preferred where the disposal of waste presents an environmental problem. However, many of the known acid zinc plating baths do not produce bright zinc deposits unless the baths contain complexing agents for zinc. Examples of complexing agents which have been utilized in acid zinc baths include organic zinc complexing agents such as hydroxycarboxylic acids or salts thereof, ethylenediamine tetraacetic acid or salts thereof or similar materials which prevent the precipitation of zinc from the bath as the insoluble hydroxide at higher values of pH. Almost all of the baths of the prior art used for depositing bright zinc coatings within the mild acid range also contain large quantities of ammonium salts such as ammonium chloride. The complex forming properties of these ammonium salts and organic salts which is desirable in the plating bath itself is, however, a problem in disposal of the used acid bath. Such complexing agents impede the removal of zinc ions from the waste electrolyte by precipitation in the weakly alkaline pH range and may require special measures for effecting the precipitation of the metals from the bath prior to disposal. Also, the presence of ammonia in the plating bath is undesirable because of the biochemical oxygen demand caused by ammonia, and the chlorine demand of the ammonia in waste treatment facilities.

Acid zinc plating baths which are substantially free of ammonium ions have been described in U.S. Pat. No. 3,928,149. These baths contain, in addition to zinc ions, and an aromatic carbonyl compound, a polypropoxyether having a molecular weight of from about 300 to 1500 and/or a polypropoxy-ethoxy ether having a molecular weight of about 1,000 to about 5,000 and containing up to a maximum of 25% by weight of oxyethylene units. Such baths are reported to produce bright zinc deposits in the absence of ammonium salts.

U.S. Pat. No. 3,920,528 also describes electrolytes free from significant amounts of complexing agents that would impede precipitation of zinc ions at weakly alkaline pH. The plating bath described in this patent contains zinc ions, an inert salt for improving the conductivity of the electrolyte, and a brightener. The preferred brighteners are derivatives of nitrogen-containing heterocyclic rings such as pyridine-3-acetic acid and pyridine-3-sulfonic acid.

SUMMARY OF THE INVENTION

It has now been found that satisfactory bright, level and ductile zinc electrodeposits can be obtained from electroplating baths which are free of ammonia or amines and which contain zinc ions, chloride ions, at least one polyoxyalkylated naphthol, at least one aromatic carboxylic acid or bath-soluble salt thereof, and at least one anionic aromatic sulfonic acid bath-soluble salt thereof. While acid plating baths containing the ingredients mentioned above will produce zinc electrodeposits of good brightness over a wide current density range, the properties of the electrodeposit may be improved further by the incorporation of other additives including additional brightening agents, stress-relieving additives such as nonionic polyoxyethylene compounds, aromatic aldehydes, or ketones, wetting agents, etc. The present invention also comprises methods for the electrodeposition of bright and level zinc deposits from such acid baths as well as additive compositions for forming the aqueous acid zinc plating baths of the invention.

DESCRIPTION OF THE PREFERRED EMBODIMENTS

The acidic electroplating baths of the invention are ammonia-free zinc plating baths comprising zinc ions, chloride ions, at least one polyoxyalkylated naphthol, at least one aromatic carboxylic acid or bath-soluble salt thereof, and at least one anionic aromatic sulfonic acid or bath-soluble salt thereof. The polyoxyalkylated naphthols useful in the baths of this invention are obtained by reacting a naphthol with an alkylene oxide such as ethylene oxide and propylene oxide and more particularly, with from about 6 to about 40 moles of ethylene oxide per mole of naphthol. The naphthol reactant may be either $\alpha$- or $\beta$- naphthol and the naphthalene ring may contain various substituents such as the alkyl groups or alkoxy groups, especially lower alkyl and lower alkoxy groups of up to seven carbon atoms each, so long as the polyoxyalkylated naphthol remains bath-soluble. When present, there usually will not be more than two such substituents per polyoxyalkylated naphthol; that is, two lower alkoxy groups, two lower alkyl groups, or a lower alkyl or a lower alkoxy group. The preferred polyoxyalkylated naphthols are ethoxylated naphthols having the formula:

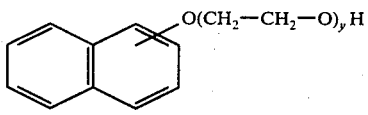

FORMULA I wherein $y$ is from about 6 to about 40 and preferably from about 8 to about 20.

At least one aromatic carboxylic acid or bath-soluble salt of an aromatic carboxylic acid is included in the zinc plating baths of the invention. Aromatic carboxylic acids such as benzoic acid and salicylic acid are preferred. Examples of bath-soluble salts include the sodium and potassium salts of benzoic acid and salicylic acid. The amount of aromatic carboxylic acid included in the acid zinc plating bath of the invention is an amount which is effective to provide a bright and level zinc deposit which can be determined readily by one skilled in the art. In general, amounts ranging from about 1 to about 10 grams per liter of at least one aromatic carboxylic acid or water-soluble salt thereof have been found to be effective.

The acid zinc plating baths of the invention also contain at least one anionic aromatic sulfonic acid or bath-soluble salt thereof. The anionic aromatic sulfonic acid may be a compound obtained by the polycondensation of formaldehyde and an aromatic sulfonic acid which is generally naphthalene sulfonic acid. Condensation products of this type which are useful in the invention have the formula:

FORMULA II

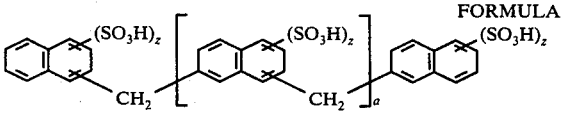

and/or

FORMULA III

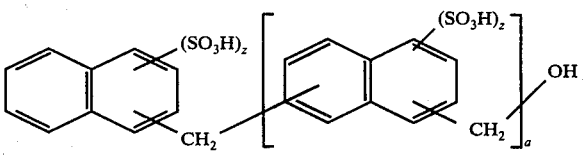

wherein $z$ is an integer from 1 to 3 and $a$ is an integer from 1 to 14, preferably from 2 to 6. Polycondensation products of this type are known compounds and their production is described in, for example, Houben-Weyl, "Methoden Der Organishen Chemie," Volume XIV/2, at page 316, and said description is hereby incorporated by reference. The utility of these condensation products in ammonium-containing acid zinc baths is described in U.S. Pat. No. 3,878,069.

The general method of preparing these polycondensation products involves reaction of formaldehyde solution with naphthalene sulfonic acid at a temperature of from about 60° to 100° C. until the formaldehyde odor has disappeared. Similar products can be obtained by sulfonation of naphthalene formaldehyde resins. The condensation products obtained in this manner contain two or more naphthalene sulfonic acids linked by methylene bridges which can have from one to three sulfonic acid groups. These anionic aromatic sulfonic acid compounds may be introduced into the plating baths either in their acid form or as the water-soluble salts which may be the sodium or potassium salts. The amount of the anionic polycondensation product included in the acid plating baths of the invention will vary depending upon the other ingredients in the plating baths but should be an amount effective to impart brightness, ductility, and malleability to the zinc deposit obtained from the baths.

The anionic aromatic sulfonic acid utilized in the acid zinc plating baths of the invention also may be a water-soluble salt of tetrahydronaphthalene sulfonate such as the sodium or potassium salts. Generally, from about 5 to about 15 grams of the salt of tetrahydronaphthalene sulfonate will be used per liter of plating bath. The presence of the tetrahydronaphthalene sulfonic acid widens the bright current density range in both the high and low current densities and permits the use of rather vigorous air agitation because of its low foaming property. In some applications, it is preferred to use a mixture of the water-soluble salts of tetrahydronaphthalene sulfonic acid with a water-soluble salt of a polycondensation product of formaldehyde and an aromatic sulfonic acid.

The properties of the bright and level zinc deposits produced by the plating baths of the invention may be improved by incorporating additional additives. It has been found, for example, that the brightness of the deposit can be improved through the use of at least one nonionic polyoxyethylene compound selected from the compounds of the formula:

FORMULA IV

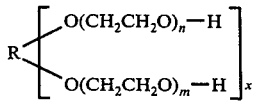

wherein $m$ may be zero, the sum of $m+n$ is at least 10, $x$ is 1 or 2, and the compound is derived from a reaction of ethylene oxide with a polyol selected from the group consisting of 2,4,7,9-tetramethyl-5-decyne-4,7-diol; polyoxypropylene glycol of a molecular weight of at least about 9,000; and N,N,N',N'-tetrakis(polyoxypropylene glycol)ethylene diamine of a molecular weight of at least about 500; and wherein R is defined by the selected polyol. The molecular weights of the polyoxypropylene glycol and the ethylene diamine compounds should not be as high as to form a bath-insoluble compound of Formula IV.

Nonionic polyoxyethylene compounds of this type, and their utility in acid zinc baths containing ammonium ions are described in U.S. Pat. No. 3,855,085. Such polyoxyethylene compounds are available commercially under the general trade designations "Surfynol" by Air Products and Chemicals, Inc. of Wayne, Pa., and under the designation "Pluronic" or "Tetronic" by BASF Wyandotte Corp. of Wyandotte, Mich. Examples of specific polyoxyethylene condensation products useful in the invention include "Surfynol 465" which is a product obtained by reacting 10 moles of ethylene oxide with 1 mole of tetramethyldecynediol. "Surfynol 485" is the product obtained by reacting 30 moles of ethylene oxide with tetramethyldecynediol. "Pluronic L 35" is a product obtained by reacting 22 moles of ethylene oxide with polypropylene glycol obtained by the condensation of 16 moles of propylene glycol.

The brightness of the zinc deposit obtained with the baths and with the process of the invention is most effectively improved if the bath contains at least one aromatic aldehyde, aromatic ketone, or mixtures of aromatic aldehydes and ketones. These supplementary brighteners impart optimum leveling action of specular brightness over a wide plating range.

The following compounds will illustrate the types of aromatic aldehydes and aromatic ketones which have been found useful as brighteners in the plating baths of the invention: ortho-chlorobenzaldehyde, para-chlorobenzaldehyde, benzylidene acetone, coumarin, 1,2,3,6-tetrahydrobenzaldehyde, acetophenone, propiophenone, furfurylidine acetone, 3-methoxybenzal acetone, etc. Mixtures of one or more of the above aldehydes with one or more ketones also are useful. When employed in the baths of the invention, the brighteners will be included within the range of from about 0.02 to about 1 gram per liter and preferably from about 0.03 to about 0.5 grams per liter of bath.

The above-identified bath additives are included in the ammonia-free aqueous acidic zinc plating baths of the invention. The plating baths of the invention contain free zinc ions and are prepared with water-soluble zinc salts such as zinc chloride, zinc sulfate, zinc fluoroborate, zinc acetate, and/or zinc sulphamate. The zinc ion concentration in the plating baths of the invention may vary over a wide range such as from about 15 to about 75 grams per liter and preferably from about 22 to about 55 grams per liter. The baths containing lower amounts of zinc ion are particularly useful for barrel plating operations where drag-out losses represent a substantial economic problem, and where better plate distribution is desired at lower current densities. For most plating operations, and particularly for rack plating operations, the zinc ion concentration will be higher.

The plating baths of the invention also contain conductive salts which generally are salts of alkali metals such as sodium and/or potassium, including the sulfates, chlorides, fluoroborates and acetates, either alone or in combination. Since it is generally preferred that the plating baths of the invention contain from about 75 to about 150 or 200 grams per liter of chloride ion, the alkali metal chlorides preferably are used in combination with zinc chloride in the preparation of the baths of the invention.

As mentioned above, boric acid normally is included in the plating baths of the invention. Boric acid serves as a weak buffer to control pH and the cathode film. The boric acid also is helpful in smoothing the zinc deposit and is believed to have a cooperative effect with the leveling agents included in the baths of the invention. The concentration of boric acid in the baths of the invention is not critical and generally will be in the range of from about zero to about 60 grams per liter, preferably from about 30 to 40 grams per liter.

The acidic zinc electroplating baths of the invention may be utilized to produce bright ductile zinc deposits on all types of metals and alloys, for example, on zinc die cast, copper, brass, malleable and cast iron, and carbonitrided and high carbon heat-treated steel. The plating baths of the invention may be employed in all types of industrial zinc plating processes including steel plating baths, high-speed plating baths for strip or wire coating, and in barrel plating.

The acidic zinc plating bath of the present invention will deposit a bright and ductile zinc deposit on substrates at any conventional temperature such as from about 20° to about 60° C. and, more preferably, from about 20° to about 35° C. The acidity of the bath may vary from a pH of from about 3 or 4 to about 6, but preferably is operated at a pH of from about 5.2 to about 5.7. Hydrochloric acid may be used to lower the pH, and potassium hydroxide may be used to raise the pH when necessary.

Two typical ammonia-free acidic zinc plating baths in which the additive compositions of the invention may be added are as follows:

| Bath No. 1 | |
|---|---|
| Zinc chloride | 105 g/l |
| Potassium chloride | 210 g/l |
| Boric acid | 20 g/l |
| pH | 4.7 |

This formulation is suitable especially for plating current densities from about 3.0A/dm$^2$ to 10A/dm$^2$ although it may be utilized for current densities below 3.0A/dm$^2$.

| Bath No. 2 | |
|---|---|
| Zinc chloride | 50 g/l |
| Potassium chloride | 140 g/l |
| Boric acid | 20 g/l |
| pH | 4.7 |

This more dilute bath is particularly suited for barrel plating operations where current densities average below 2.0A/dm$^2$.

The following specific examples illustrate the utility of the plating baths of the invention and the method of electrodepositing zinc plate from such baths by plating steel Hull cell panels in a 267ml. Hull cell. The baths were prepared as indicated by including the specified additive combination described in Table I in either Bath 1 or Bath 2. Current densities were measured with a Hull cell scale. The panels were plated at 1 or 3 amperes for five minutes from a DC rectifier. The solutions were mechanically agitated.

Table 1

ADDITION AGENT COMPONENT COMBINATIONS IN GRAMS PER LITER OF BATH

| COMPONENT | A | B | C | D | E |
|---|---|---|---|---|---|
| Sodium salt of tetrahydronaphthalene sulfonic acid | 6.0 | 6.0 | 6.0 | 6.0 | 6.0 |
| Blancol N (a sodium salt of a sulfonated naphthalene condensate, available commercially from GAF Corp.) | 0.6 | 0.6 | — | 0.6 | 0.6 |
| Surfynol 465 (tetramethyl decynediol ethoxylated with ten moles of ethylene oxide, available commercially from Air Products) | 1.5 | 1.5 | 1.5 | 1.5 | 1.5 |
| The reaction product of -naphthol reacted with twelve moles of ethylene oxide | 0.4 | 0.4 | 0.4 | 0.4 | 0.4 |
| Sodium salt of benzoic acid | — | 2.0 | 2.0 | 2.0 | 2.0 |
| Sodium salt of salicylic acid | 2.25 | — | — | — | 2.25 |
| Benzylidene acetone | 0.05 | 0.05 | 0.05 | — | — |
| Ortho-chlorobenzaldehyde | — | — | — | 0.1 | 0.1 |

EXAMPLE 1

Bath No. 1
Current across Hull Cell—3 amperes
Addition combination A from Table I
Results—bright, level zinc plate from below 0.15A/dm$^2$ to above 12.0A/dm$^2$

EXAMPLE 2

Bath No. 1
Current—3 amperes
Addition combination B
Result—bright, level zinc plate from below 0.15A/dm$^2$ to above 12.0A/dm$^2$

EXAMPLE 3

Bath No. 1
Current—1 ampere
Addition combination C
Result—bright, level zinc plate from below 0.05A/dm$^2$ to above 4.0A/dm$^2$

EXAMPLE 4

Bath No. 1
Current—3 amperes
Addition combination D
Result—similar to Example No. 1

EXAMPLE 5

Bath No. 1
Current—3 amperes
Addition combination E
Result—similar to Example No. 1

EXAMPLE 6

Bath No. 2
Current—1 ampere
Addition combination B
Result—bright, level zinc plate from below 0.05A/dm$^2$ to above 4.0A/dm$^2$ with dull, mat zinc plate on the high current density edge of the Hull Cell panel.

In practice, the improved zinc plating baths of the invention may be operated on a continuous or intermittent basis, and from time to time, the components of the bath have to be replenished. The various components may be added singularly as required or may be added in combination. The amounts of the various additive compositions to be added to the plating baths may be varied over a wide range depending on the nature and performance of the zinc plating bath to which the composition is added. Such amounts can be determined readily by one skilled in the art.

Another aspect of the invention relates to additive compositions which may be mixtures of various additives without any solvent or carrier or they may be concentrates of bath components in water, alcohols, or mixtures of water and one or more alcohols. The additive compositions will comprise the polyoxyalkylated naphthol, the aromatic carboxylic acid or bath-soluble salt thereof, and at least one anionic aromatic sulfonic acid or bath-soluble salt thereof. In addition to the above-described components, the additive compositions may contain any or all of the additives discussed above such as at least one nonionic polyoxyethylene compound, at least one aromatic aldehyde, ketone or mixtures thereof, as desired. The amounts of the compounds in the additive composition or concentrates will be such that when they are diluted and added to the baths, they will provide the requisite amounts of the components in the bath or the requisite amounts of the components required to replenish the bath.

The following additive compositions or concentrates in addition to those listed in Table I illustrate the various combinations of compounds that may be prepared and utilized in accordance with the invention for preparing or maintaining the baths of the invention and/or improving the performance of the baths of the invention.

| | Parts by Weight |
|---|---|
| Additive Composition F | |
| The reaction product of β-naphthol reacted with ten moles of ethylene oxide | 5 |
| Sodium benzoate | 20 |
| Blancol N (a sodium salt of a sulfonated naphthalene formaldehyde concentrate available commercially from GAF Corp.) | 10 |
| Water | 65 |
| Additive Composition G | |
| The ethoxylated β-napthol of Composition F | 5 |
| Sodium salt of salicylic acid | 25 |
| Blancol N | 10 |
| Surfynol 465 (tetramethyl decynediol ethoxylated with ten moles of ethylene oxide, available commercially from Air Products) | 15 |
| Water | 45 |
| Additive Composition H | |
| Ethoxylated β-naphthol of Composition F | 5 |
| Sodium salt of benzoic acid | 20 |
| Sodium salt of tetrahydronaphthalene sulfonic acid | 15 |
| Water | 50 |
| Additive Composition I | |
| The ethoxylated β-naphthol of Composition F | 5 |
| Sodium salt of salicyclic acid | 25 |
| Blancol N | 10 |
| Surfynol 465 (tetramethyl decynediol ethoxylated with ten moles of ethylene oxide, available commercially from Air Products) | 15 |
| Benzylidene acetone | 1 |
| Water | 44 |

The embodiments of the invention in which an exclusive property or privilege is claimed are defined as follows:

1. An ammonia-free aqueous acid zinc electroplating bath comprising zinc ions, chloride ions, at least one polyoxyalkylated naphthol, at least one aromatic carboxylic acid or bath-soluble salt thereof, and at least one anionic aromatic sulfonic acid or bath-soluble salt thereof.

2. The electroplating bath of claim 1 wherein the bath also contains at least one nonionic polyoxyethylene compound selected from the compounds of the formula:

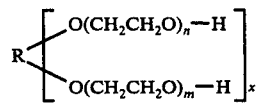

wherein $m$ may be zero, the sum of $m+n$ is at least 10, $x$ is 1 or 2, and the compound is derived from a reaction of ethylene oxide with a polyol selected from the group consisting of 2,4,7,9-tetramethyl-5-decyne-4,7-diol; polyoxypropylene glycol of a molecular weight of at least about 9,000; and N,N,N',N'-tetrakis(polyoxypropylene glycol)ethylene diamine of a molecular weight of at least about 500; and wherein R is defined by the selected polyol.

3. The electroplating bath of claim 2 wherein the bath also contains at least one aromatic aldehyde, ketone, or mixtures thereof.

4. The electroplating bath of claim 3 wherein the aromatic ketone is benzylidene acetone.

5. The electroplating bath of claim 1 wherein the polyoxyalkylated naphthol has the formula:

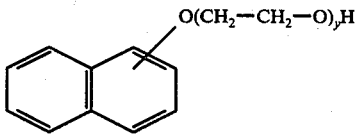

wherein $y$ is from about 6 to about 40.

6. The electroplating bath of claim 5 wherein the polyoxyalkylated naphthol is derived from a $\beta$- naphthol.

7. The electroplating bath of claim 1 wherein the aromatic carboxylic acid is benzoic acid, salicylic acid, a bath-soluble salt thereof, or mixtures of two or more of these.

8. The electroplating bath of claim 1 wherein the anionic aromatic sulfonic acid is a compound obtained by the polycondensation of formaldehyde and aromatic sulfonic acid.

9. The electroplating bath of claim 8 wherein the aromatic sulfonic acid is a naphthalene sulfonic acid.

10. The electroplating bath of claim 9 wherein the polycondensation product of formaldehyde and naphthalene sulfonic acid is a water-soluble condensation product of formaldehyde with at least two naphthalene sulfonic acids linked by methylene bridges and which contains from one to three sulfonic acid groups in an amount effective to impart ductility and malleability to the zinc deposit obtained from said bath.

11. The electroplating bath of claim 1 wherein the bath-soluble aromatic sulfonic acid salt is a salt of tetrahydronaphthalene sulfonic acid.

12. The electroplating bath of claim 1 wherein the bath-soluble salt of the aromatic sulfonic acid is a mixture of a sodium salt of a polycondensation product of formaldehyde and naphthalene sulfonic acid and the sodium salt of tetrahydronaphthalene sulfonic acid.

13. An ammonia-free aqueous acid zinc electroplating bath comprising from about 22 to 55 grams per liter of zinc ion, from about 75 to about 150 grams per liter of chloride ion, from about 0 to about 40 grams per liter of boric acid, at least one polyoxyalkylated naphthol in an amount sufficient to provide a bright and level zinc deposit, from about 5 to about 15 grams per liter of bath-soluble tetrahydronaphthalene sulfonate, from zero to about 1.5 grams per liter of at least one bath-soluble salt of the polycondensation product of formaldehyde and naphthalene sulfonic acid, from about one to about ten grams per liter of at least one aromatic carboxylic acid or water-soluble salt thereof, from about 0 to about 1.0 grams per liter of at least one aromatic aldehyde, ketone or mixtures thereof, and from 0 to 2.5 grams per liter of at least one polyoxyethylene compound selected from the compounds of the formula:

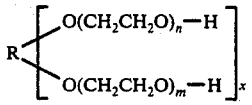

wherein $m$ may be zero, the sum of $m+n$ is at least 10, $x$ is 1 or 2, and the compound is derived from the reaction of ethylene oxide with a polyol selected from the group consisting of 2,4,7,9-tetramethyl-5-decyne-4,7-diol; polyoxypropylene glycol of a molecular weight of at least about 9,000; and N,N,N',N'-tetrakis(polyoxypropylene glycol)ethylene diamine of a molecular weight of at least about 500; and wherein R is defined by the selected polyol.

14. The electroplating bath of claim 13 wherein the polyoxyalkylated naphthol has the formula:

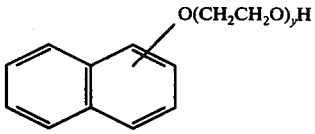

wherein $y$ is from about 6 to 40.

15. The electroplating bath of claim 13 wherein the polycondensation product of formaldehyde and naphthalene sulfonic acid is a water-soluble condensation product of formaldehyde with at least two naphthalene sulfonic acids linked by methylene bridges and which contains from one to three sulfonic acid groups in an amount effective to impart ductility and malleability to the zinc deposit obained from said bath.

16. The electroplating bath of claim 13 wherein the aromatic carboxylic acid is benzoic acid, salicylic acid, a bath-soluble salt thereof or mixtures of two or more of these.

17. The electroplating bath of claim 13 wherein the aromatic ketone is benzylidene acetone.

18. The electroplating bath of claim 13 wherein the polyoxyethylene compound is derived by reacting about 10 moles of ethylene oxide with about 1 mole of 2,4,7,9-tetramethyl-5-decyne-4,7-diol.

19. The method of electrodepositing a zinc coating on a substrate which comprises electroplating said substrate in an ammonia-free aqueous acidic zinc bath comprising zinc ions, chloride ions, at least one polyoxyalkylated naphthol, at least one aromatic carboxylic acid or bath-soluble salt thereof, and at least one anionic aromatic sulfonic acid or bath-soluble salt thereof.

20. The method of claim 19 wherein the bath also contains at least one nonionic polyoxyethylene compound selected from the compounds of the formula:

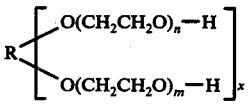

wherein $m$ may be zero, the sum of $m+n$ is at least 10, $x$ is 1 or 2, and the compound is derived from a reaction of ethylene oxide with a polyol selected from the group consisting of 2,4,7,9-tetramethyl-5-decyne-4,7-diol; polyoxypropylene glycol of a molecular weight of at least about 9,000; and N,N,N',N'-tetrakis(polyoxypropylene glycol)ethylene diamine of a molecular weight of at least about 500; and wherein R is defined by the selected polyol.

21. The method of claim 20 wherein the bath also contains at least one aromatic aldehyde, ketone, or mixtures thereof.

22. The method of claim 21 wherein the aromatic ketone is benzylidene acetone.

23. The method of claim 19 wherein the polyoxyalkylated naphthol has the formula:

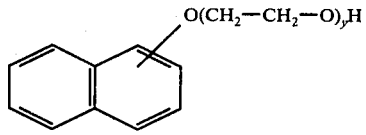

wherein $y$ is from about 6 to about 40.

24. The method of claim 23 wherein the polyoxyalkylated naphthol is derived from a $\beta$- naphthol.

25. The method of claim 19 wherein the aromatic carboxylic acid is benzoic acid, salicylic acid, a bath-soluble salt thereof, or mixtures of two or more of these.

26. The method of claim 19 wherein the anionic aromatic sulfonic acid is a compound obtained by the polycondensation of formaldehyde and aromatic sulfonic acid.

27. The method of claim 26 wherein the aromatic sulfonic acid is a naphthalene sulfonic acid.

28. The method of claim 27 wherein the polycondensation product of formaldehyde and naphthalene sulfonic acid is a water-soluble condensation product of formaldehyde with at least two naphthalene sulfonic acids linked by methylene bridges and which contains from one to three sulfonic acid groups in an amount effective to impart ductility and malleability to the zinc deposit obtained from said bath.

29. The method of claim 19 wherein the bath-soluble salt of the aromatic sulfonic acid is a bath-soluble salt of tetrahydronaphthalene sulfonic acid.

30. The method of claim 19 wherein the bath-soluble salt of the aromatic sulfonic acid is a mixture of a sodium salt of a polycondensation product of formaldehyde and naphthalene sulfonic acid and the sodium salt of tetrahydronaphthalene sulfonic acid.

31. The method of electrodepositing a zinc coating on a substrate which comprises electroplating said substrate in an ammonia-free aqueous acid zinc plating bath comprising from about 22 to 55 grams per liter of zinc ion, from about 75 to about 150 grams per liter of chloride ion, from about zero to about 40 grams per liter of boric acid, at least one polyoxyalkylated naphthol in an amount sufficient to provide a bright and level zinc deposit, from about 5 to about 15 grams per liter of bath-soluble tetrahydronaphthalene sulfonate, from 0 to about 1.5 grams per liter of at least one bath-soluble salt of the polycondensation product of formaldehyde and naphthalene sulfonic acid, from about one to about ten grams per liter of at least one aromatic carboxylic acid or water-soluble salt thereof, from about 0 to about 1.0 grams per liter of at least one aromatic aldehyde, ketone or mixtures thereof, and from 0 to 2.5 grams per liter of at least one polyoxyethylene compound selected from the compounds of the formula:

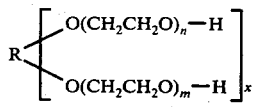

wherein $m$ may be zero, the sum of $m+n$ is at least 10, $x$ is 1 or 2, and the compound is derived from the reaction of ethylene oxide with a polyol selected from the group consisting of 2,4,7,9-tetramethyl-5-decyne-4,7-diol; polyoxypropylene glycol of a molecular weight of at least about 9,000; and N,N,N',N'-tetrakis(polyoxypropylene glycol)ethylene diamine of a molecular weight of at least about 500; and wherein R is defined by the selected polyol.

32. The method of claim 31 wherein the polyoxyalkylated naphthol has the formula:

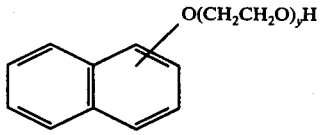

wherein $y$ is from about 6 to 40.

33. The method of claim 31 wherein the polycondensation product of formaldehyde and naphthalene sulfonic acid is a water-soluble condensation product of formaldehyde with at least two naphthalene sulfonic acids linked by methylene bridges and which contains from one to three sulfonic acid groups in an amount effective to impart ductility and malleability to the zinc deposit obained from said bath.

34. The method of claim 31 wherein the aromatic carboxylic acid is benzoic acid, salicylic acid, a bath-soluble salt thereof or mixtures of two or more of these.

35. The method of claim 31 wherein the aromatic ketone is benzylidene acetone.

36. The method of claim 31 wherein the polyoxyethylene compound is derived by reacting about 10 moles of ethylene oxide with about one mole of 2,4,7,9-tetramethyl-5-decyne-4,7-diol.

37. An additive composition for an aqueous acidic zinc electroplating bath comprising a mixture of:

(a) at least one polyoxyalkylated naphthol, (b) at least one aromatic carboxylic acid or bath-soluble salt thereof, and (c) at least one anionic aromatic sulfonic acid or bath-soluble salt thereof.

38. The additive composition of claim 37 wherein the mixture also contains (d) at least one nonionic polyoxyalkylene compound selected from the compounds of the formula:

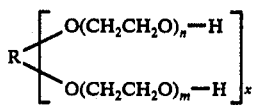

wherein $m$ may be zero, the sum of $m+n$ is at least 10, $x$ is 1 or 2, and the compound is derived from a reaction of ethylene oxide with a polyol selected from the group consisting of 2,4,7,9-tetramethyl-5-decyne-4,7-diol; polyoxypropylene glycol of a molecular weight of at least about 9,000; and N,N,N',N'-tetrakis(polyoxypropylene glycol)ethylene diamine of a molecular weight of at least about 500; and wherein R is defined by the selected polyol.

39. The additive composition of claim 38 wherein the mixture also contains (e) at least one aromatic aldehyde, ketone, or mixtures thereof.

40. The additive composition of claim 39 wherein the aromatic aldehyde is benzylidine acetone.

41. The additive composition of claim 38 wherein the nonionic polyoxyethylene compound is derived by reacting about ten moles of ethylene oxide with one mole of 2,4,7,9-tetramethyl-5-decyne-4,7-diol.

42. The additive composition of claim 37 wherein the polyoxyalkylated naphthol comprises the product obtained by reacting ethylene oxide with $\beta$- naphthol.

43. The additive composition of claim 37 wherein the aromatic carboxylic acid is benzoic acid, salicylic acid, a bath-soluble salt thereof, or mixtures of two or more of these.

44. The additive composition of claim 37 wherein the anionic aromatic sulfonic acid comprises a mixture of a sodium salt of a polycondensation product of formaldehyde and naphthalene sulfonic acid and the sodium salt of tetrahydronaphthalene sulfonic acid.

* * * * *